United States Patent [19]

Helm et al.

[11] Patent Number: 4,877,092

[45] Date of Patent: Oct. 31, 1989

[54] NEAR BIT OFFSET STABILIZER

[75] Inventors: Charles W. Helm, Rocky Hill; Vernon E. Koval, Middletown, both of Conn.

[73] Assignee: Teleco Oilfield Services Inc., Meriden, Conn.

[21] Appl. No.: 181,915

[22] Filed: Apr. 15, 1988

[51] Int. Cl.[4] ..... E21B 7/08

[52] U.S. Cl. ..... 175/74; 175/325

[58] Field of Search ..... 175/61, 73, 74, 75, 175/325; 166/271

[56] References Cited

U.S. PATENT DOCUMENTS

| | | | |
|---|---|---|---|
| 1,701,427 | 2/1929 | Shields | 175/325 X |
| 1,888,216 | 11/1932 | Bull | 175/325 |
| 3,916,998 | 11/1975 | Bass, Jr. et al. | 136/301 |
| 4,067,404 | 1/1978 | Crase | 175/75 |
| 4,071,285 | 1/1978 | Kellner | 175/325 |
| 4,076,084 | 2/1978 | Tighe | 175/73 |
| 4,077,657 | 3/1978 | Trzeciak | 175/74 X |
| 4,303,135 | 12/1981 | Benoit | 175/73 |
| 4,319,649 | 3/1982 | Jeter | 175/73 |
| 4,465,147 | 8/1984 | Feenstra et al. | 175/73 |
| 4,549,613 | 10/1985 | Case | 175/325 |
| 4,560,013 | 12/1985 | Beimgraben | 175/73 |
| 4,577,701 | 3/1986 | Dellinger et al. | 175/61 |
| 4,610,307 | 9/1986 | Jürgens et al. | 175/325 |
| 4,667,751 | 5/1987 | Geczy et al. | 175/61 |
| 4,697,651 | 10/1987 | Dellinger | 175/61 |
| 4,745,982 | 5/1988 | Wenzel | 175/74 |

*Primary Examiner*—William P. Neuder

*Attorney, Agent, or Firm*—Fishman, Dionne & Cantor

[57] ABSTRACT

A near bit offset stabilizer for use with a bent sub or bent motor housing is presented wherein a mechanism is provided to correctly orient and lock the stabilizer in a desired position in alignment with the bend angle in the bent sub or bent motor housing. This alignment and locking mechanism comprises a ring nut having a series of radial slots on its lower end; and the provision of a series of corresponding radial slots on the upper end of the stabilizer. The corresponding slots permit mutual interlocking between the ring nut and stabilizer for locking the stabilizer in any one of a plurality of radial positions. A scribe line or other indicia on the stabilizer permits visual alignment with the bend in the bent sub or bent motor housing in the drill string above. Finally, a second nut locks the stabilizer in the selected radial position. An important feature of the present invention is that the offset stabilizer may be easily radially adjusted and locked in a given orientation with the desired orientation typically being in alignment with the bend in a bent sub or bent motor housing to enhance directional drilling. Another feature of the present invention is that the slotted ring nut may be easily removed permitting the utilization of a conventional stabilizer (concentric or offset) or permitting the deletion of a stabilizer altogether.

43 Claims, 3 Drawing Sheets

20
18
10
16
22
27
24
25
32
38
14
46
44
38'
44'
40
43
26
12
38'
46
44
44'
46
40
38
28
27
16
22
24'
24
25
48
54
50
52
14'
44
46'
50
40
27
25
48
46
44'
46'
50
40

NEAR BIT OFFSET STABILIZER

BACKGROUND OF THE INVENTION

This invention relates to oil and gas well drilling. More particularly, this invention relates to directional drilling of boreholes using a bent sub or bent motor housing and an offset stabilizer in combination with a downhole motor such as a turbodrill or a positive displacement Moineau (PDM) motor.

Directional drilling, that is, the change in direction of drilling in the bore of subterranean well is well known and has been practiced for many years. In many instances, the change in direction is to produce a straightening of the well due to the deflection of the rotary drill from the desired direction by a particular rock strata. In other instances, the change in direction is intentional in order to reach a formation that is laterally displaced from the existing location of the bore hole.

One of the most common expedients for changing the direction of drilling has been the insertion in the drilling or work string, at a point above a downhole motor which drives the rotary drill bit, of an apparatus which is called a bent sub. Such bent subs are rigidly connected at one end to the work string and have their other connecting end angularly disposed relative to the axis of the work string to which they are connected, so that when the motor and supported drill bit are rigidly connected thereto, the axis of the drill bit will be angularly inclined relative to the axis of the well bore existing prior to insertion of the bent sub.

Alternatively, the required bend for changing the drilling direction may be incorporated directly in the downhole motor housing. Such apparatuses are known as bent motor housings and work in a substantially similar fashion to bent subs.

Still another method of changing the direction of drilling is the incorporation of an eccentric or offset stabilizer at the lower end of the drill string below the downhole motor and near the drill bit (defining a near bit stabilizer).

In addition, it has been found that directional drilling capabilities can be further enhanced by combining an offset near bit stabilizer with a bent sub or bent motor housing. However, this enhancement is maximized only if the offset stabilizer is radially aligned with the angle in the bent sub or bent motor housing. Unfortunately, because of the threaded connections between the drill string segments and the offset stabilizer, only random angular orientations with respect to the bent sub or bent motor housings and the offset stabilizer are produced. This is a significant drawback to the overall efficiency of directional drilling when an offset stabilizer is used in combination with a bent sub or bent motor housing.

SUMMARY OF THE INVENTION

The above discussed and other drawbacks and deficiencies of the prior art are overcome or alleviated by the near bit stabilizer for use with a bent sub or bent motor housing of the present invention. In accordance with the present invention, means are provided to correctly orient and lock a near bit offset stabilizer in a desired position in alignment with the bend angle in a bent sub or bent motor housing. This alignment and locking means comprises a ring nut having a series of radial slots on its lower end; and the provision of a series of corresponding radial slots on the upper end of an offset stabilizer. The corresponding slots permit mutual interlocking between the ring nut and stabilizer for locking the stabilizer in any one of a plurality of radial positions. A scribe line or other indicia on the stabilizer permits visual alignment with the bend in the bent sub or bent motor housing in the drill string above. Finally, a second ring nut locks the stabilizer in the selected radial position.

In an alternative embodiment, the radial slots of the ring nut may be integrally formed on the motor housing itself.

An important feature of the present invention is that the offset stabilizer may be easily radially adjusted and locked in a given orientation with the desired orientation typically being in alignment with the bend in a bent sub or bent motor housing to enhance directional drilling. Another feature of the present invention is that the slotted ring nut may be easily removed permitting the utilization of a conventional stabilizer (concentric or offset) or permitting the deletion of a stabilizer altogether.

The above discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several Figures.

DESCRIPTION OF THE PREFERRED EMBODIMENT

Figures 1, 2, 3, 4:
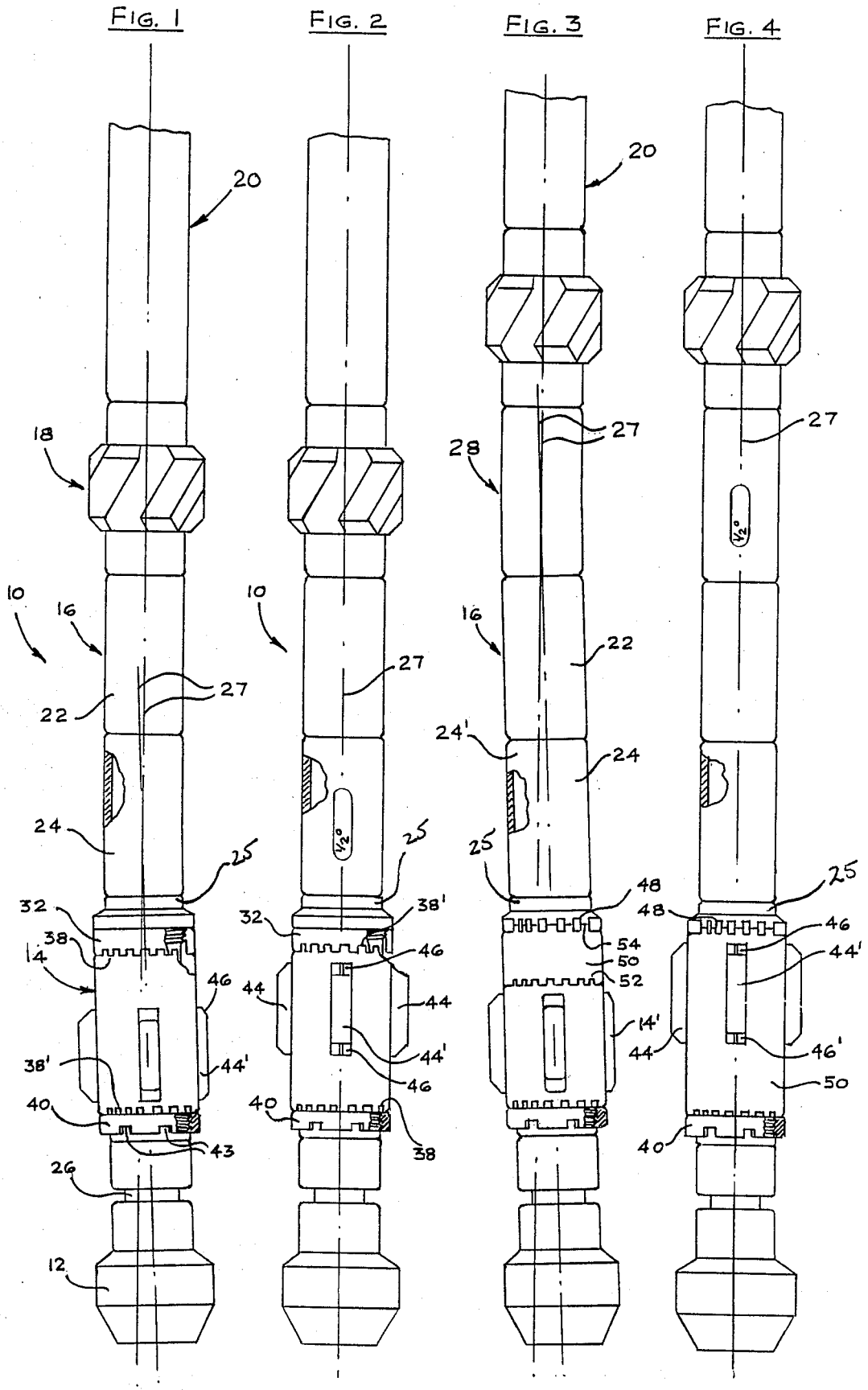
FIG. 1 is a side elevation view of a downhole assembly of a drillstring in a borehole incorporating a bent motor housing and the near bit stabilizer of the present invention.
FIG. 2 is a side elevation view of the downhole assembly of FIG. 1, but rotated 90 degrees.
FIG. 3 is a side elevation view of a downhole assembly similar to the downhole assembly of FIG. 1, but incorporating a bent sub.
FIG. 4 is a side elevation view of a downhole assembly similar to FIG. 3, but rotated 90 degrees.

Referring first to FIGS. 1 and 2, a bottomhole assembly for direction drilling of a borehole is shown generally at 10. Bottomhole assembly 10 includes a drill bit 12, an offset stabilizer 14, a downhole drilling motor 16, a concentric stabilizer 18 and a measuring-while-drilling (MWD) tool 20. Above MWD tool 20 are a plurality of drill segments (not shown) defining the remainder of the drill string. The MWD tool 20 may by any of the known MWD system such as disclosed in U.S. Pat. Nos. 3,982,431, 4,013,445 and 4,021,774, all of which are assigned to Teleco Oilfield Services, Inc. of Meriden, Connecticut (assignee of the present invention). The drilling motor 16 may be comprises of any of the known downhole motors including those motors known as turbodrills and positive displacement Moineau (PDM) motors.

In FIGS. 1 and 2, motor 16 is a PDM motor commercially available under the trademark MAGNA DRILL which is manufactured by Teleco Oilfield Services, Inc. The interior of PDM motor 16 is substantially similar to that shown in U.S. Pat. No. 4,729,675, assigned to the assignee hereof, all of the contents of which are incorporated herein by reference. The outer housing of PDM motor 16 includes a straight section 22 and a bend section 24 to define a well known "bent motor housing". Generally, straight section 22 houses the rotor/stator assembly while bend section 24 houses the flexible coupling which transmits the motor power to the drive shaft, a portion of which is shown at 26. Offset stabilizer 14 is a sleeve stabilizer which is concentrically received on the lower portion 25 of PDM motor 16. This lower portion 25 of the PDM motor corresponds to the bearing pack housing for the downhole motor as shown and described in U.S. Pat. No. 4,729,675.

It will be appreciated that FIG. 2 is identical to FIG. 1 with the exception that downhole assembly 10 has been rotated 90 degrees. As depicted by the angle lines 27 on bent motor housing sections 22 and 24 in FIG. 1, the angle of bend is directed toward the right hand side of the FIGURE and is about ½ of a degree. In FIG. 2, the bend angle is transverse to the drawing. It will be appreciated that while an angle of ½ of a degree has been shown in the drawings, any other offset angle which may be described can be used in accordance with the present invention.

FIGS. 3 and 4 show a similar downhole assembly to FIG. 1 with the primary distinction being that in FIG. 3, the drilling motor 16 is a straight tube and the bend is instead incorporated in a bent sub 28. Bent sub 28 is located between the motor 16 and the MWD tool 20. It will be appreciated that the use of a bent sub 28 (FIGS. 3 and 4) or a bent motor housing 22, 24 (FIGS. 1 and 2) will both provide directional drilling capabilities.

As mentioned, when using either a bent sub or bent motor housing, direction drilling will be enhanced with the addition of an eccentric or offset stabilizer 14. However, this enhancement will only be realized and controlled if the offset stabilizer 14 can be aligned and locked into position with respect to the bend angle 27 of the bent sub 28 or bent motor housing 22, 24. Since conventional near bit stabilizers are threadably joined to the bottomhole assembly, the orientation of the stabilizers will be random with respect to the bent sub or bent motor housing.

Figure 5:
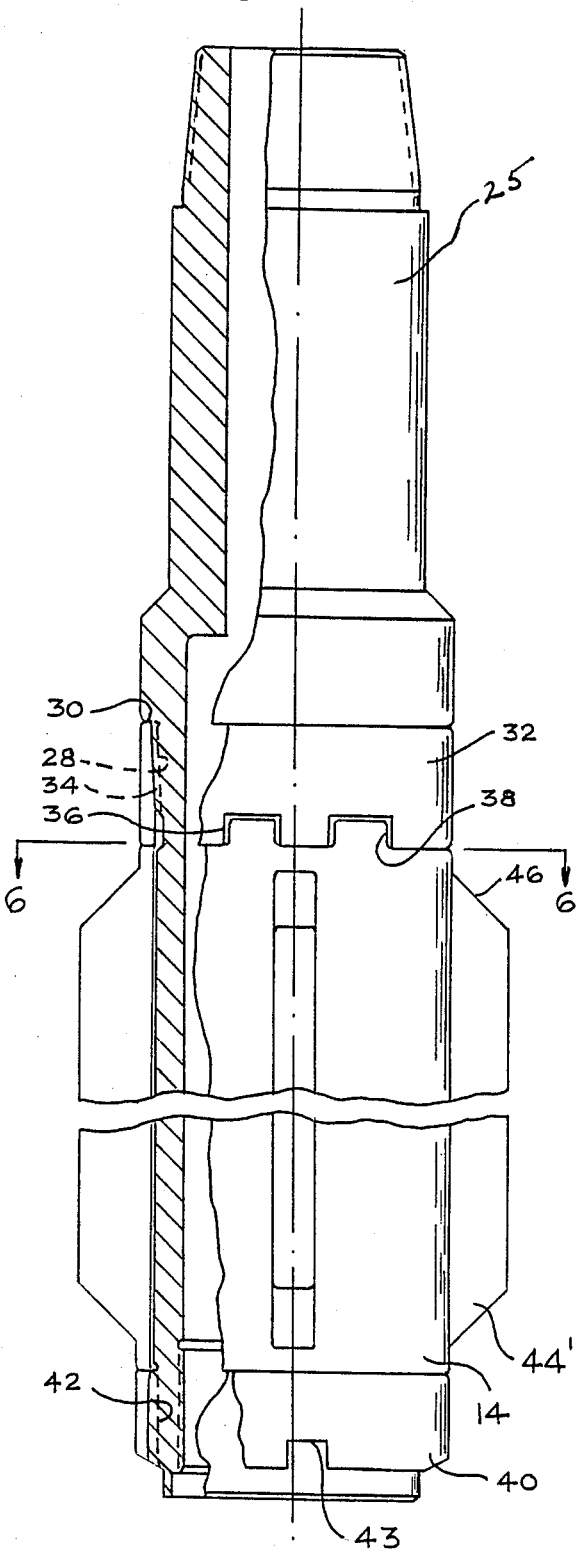
FIG. 5 is a side elevation view, partly in cross section, of the near bit stabilizer of the present invention.
Figure 6:
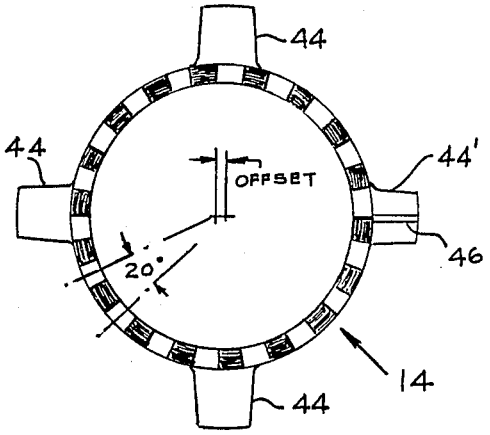
FIG. 6 is a cross sectional elevation view along the line 6—6 of FIG. 5.

Referring jointly to FIGS. 1-6, the present invention overcomes the above-noted problems by providing means for aligning and locking the near bit stabilizer into a pre-selected position. In FIGS. 1, 2 and 5, the lower portion of a downhole motor is identified at 24 and 25. As mentioned, motor housing section 24 corresponds to the flexible coupling section of the PDM motor reference. Boring pack housing segment 25 is provided with an integral thread 28 and shoulder 30 on the outside diameter thereof. An adapter ring 32 having internal threading 34 for threadably engaging threads 28 is threadably engaged to housing segment 24. Preferably, adapter ring 32 has a right hand thread orientation. Adapter ring 32 is then torqued up against shoulder 30 of segment 25.

An important feature of the present invention is the provision of a plurality of slots 36 along the radial perimeter of adapter ring 32. Complimentary slots 38 are provided to the upper end of offset stabilizer 14. It will be appreciated that slots 38 of stabilizer 14 may be mated with corresponding slots 36 of adapter ring 32 to thereby orient and hold the stabilizer in a plurality of radial positions with respect to the remaining drill string. Of course, the degree of flexibility in aligning stabilizer 14 will be a function of the number of slots or teeth 36 and 38. Preferably, eighteen (18) slots 36 and 38 are employed to provide a total of eighteen (18) radial positions in which to orient the stabilizer. However, the present invention contemplates any number of slots sufficient to provide the required variation in the stabilizer orientation. Also, while the present invention has been shown using slots having a rectangular configuration, it will be appreciated that any other suitable intermeshing or serrated configurations may be used in accordance with the present invention.

Stabilizer 14 is locked into a desired slotted orientation by use of second ring nut 40 which preferably has a left handed thread 42. Alternatively, adapter ring 32 may have a left hand thread and ring nut 40 a right hand thread; the key being that the respective threading 34 and 42 are reversed to promote locking. Ring nut 40 includes several spaced slots 43 for engaging a known torque wrench to permit tightening of ring nut 40 against stabilizer 14.

In order to enhance directional drilling, offset stabilizer 14 may be aligned with the bend angle of bent sub 28 or bent motor housing 22, 24. This may be accomplished by providing a scribe line or other indicia to stabilizer 14. It will be appreciated that the scrib e line on the stabilizer indicates to the user the direction of the offset. Stabilizer 14 generally comprises a sleeve having a plurality (in this case four) of differing sized ribs 44 thereon which provide the necessary eccentricity or offset needed for directional drilling. It will be appreciated that the degree of offset is fixed by the particular size of the ribs 44. Thus, the amount or degree of offset (or eccentricity) of sleeve stabilizer 14 may not be changed or varied; only the relative positioning of stabilizer 14 may be changed or varied with respect to the bend angle of bent sub 28 or bent motor housing 22, 24. In other words, the degree of offset in stabilizer 14 is fixed and does not vary despite changes in the relative position of stabilizer 14. In a preferred embodiment of the present invention, a scribe line 46 is provided to an upper edge of the smallest stabilizer rib 44'. Accordingly, when positioning offset stabilizer 14 on lower motor housing portion 24, the direction of bend in the bent sub or bent motor housing is aligned with the scribe line 46 on rib 44'. Thus, by aligning the smallest rib of offset stabilizer 14 with the inside of the bend of the bent sub or bent motor housing, enhancement of directional drilling is assured.

Figure 7B:
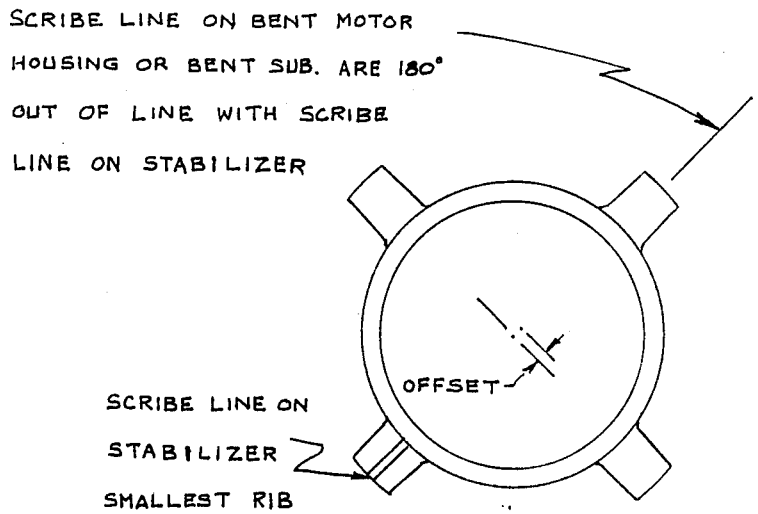
FIGS. 7A—7C are schematic views of several different configurations of the offset stabilizer and the bent housing or bent sub.

It has also been found that in some cases, enhanced directional drilling is provided by an alignment which is other than between the smallest stabilizer rib and the bend angle. Thus, it has been determined that differing geological formations and drilling techniques in various parts of the world require differing pre-selected positioning of the stabilizer and bent motor housing or bent sub. Such differing offset stabilizer/bent motor housing or sub orientations are shown in FIGS. 7A-C.

Figure 7A:
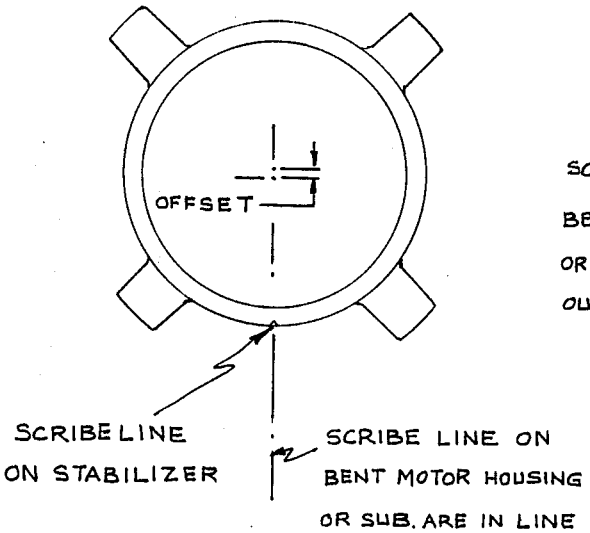
Figure 7C:
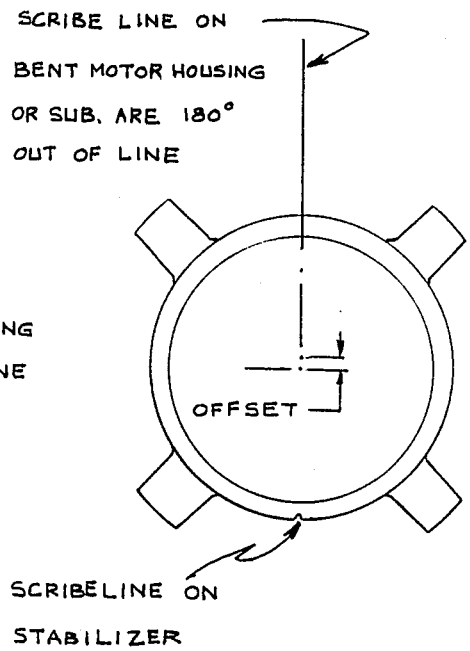

In FIG. 7A, the offset is provided between the stabilizer blades. In this case, the scribe line or similar mark would appear on the body of the stabilizer in line with the scribe line on the bent motor housing or bent sub. In FIG. 7B, the offset is 180 degrees opposed to that shown in FIGS. 1–4, that is, the offset in the stabilizer opposes the angle in the sub or bent motor housing. In FIG. 7C, the offset is between blades with the scribe line on the stabilizer being 180 degrees out of line with the bent motor housing or bent sub.

In summary, the assembly of FIGS. 1–4 may be used to complement the bent sub or bent motor housing when using the downhole motor only for a directional change. However, having made the change, the drill string is rotated while the motor is rotating the bit. An assembly as in FIG. 7B may be used to oppose the bent housing or bent sub so that when rotating while motoring, the hole diameter will remain more nearly constant. Finally, an assembly as in FIGS. 7A and 7C will have similar advantages with two stabilizer blades supporting the side loads.

In a preferred embodiment, stabilizer 14 includes a plurality of radial slots on opposed ends to render the stabilizer reversible. In addition, stabiler 14 may include another scribe line 46' on the end of rib 44' opposite scribe line 46. Thus, in FIGS. 1–4, stabilizer 14 includes a plurality of slots 38' which will mesh with slots 36 of adapter ring 32 in the event that stabilizer 14 is reversed in its positioning. Moreover, in FIG. 2 and FIG. 4, stabilizer 14 has been reversed with respect to its positioning in FIGS. 1 and 3, respectively to alter the distance between the stabilizer and the drill bit.

In an alternative embodiment depicted in FIGS. 3 and 4, the radial slots necessary for intermeshing with slots 38 on stabilizer 14 may be provided directly onto the motor housing. Thus, in FIGS. 3 and 4, radial slots 48 have been integrally formed on motor housing segment 25. In this embodiment, stabilizer 14 may be directly interlocked with radial slots 48 as in FIG. 4; or a spacer sleeve 50 having opposed radial slots 52 and 54 may be used to link together stabilizer 14 and bearing pack housing sub 25 as in FIG. 3. Note that in FIG. 4, spacer sleeve 50 is used between stabilizer 14 and locking ring nut 40. It will be appreciated that spacer sleeve 50 may be positioned above (FIG. 3) or below (FIG. 4) stabilizer 14 in order to alter the distance between the stabilizer and the drill bit.

It will be appreciated that adapter ring 32 may be easily removed to permit bearing pack housing 25 to accept other types of offset stabilizers, concentric stabilizers or no stabilizer at all. Thus, the presence of the present invention on a bottomhole assembly will not preclude the use of conventional tools and sub assemblies.

Figure 8:
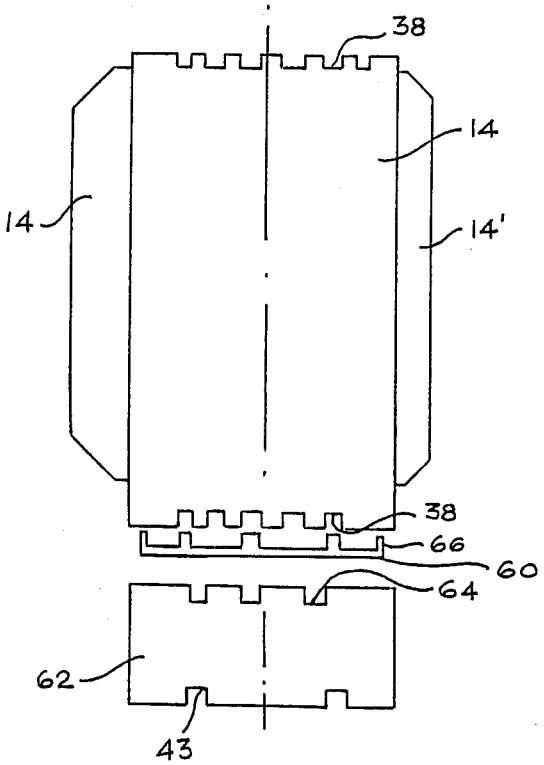
FIG. 8 in exploded side elevation view of an offset stabilizer, locking ring and locking nut in accordance with the present invention.

Referring now to FIG. 8, in a preferred embodiment, a locking ring 60 is positioned between offset stabilizer 14 and locking nut 62. In this case, locking nut 62 is provided with a plurality of radial slots 64. Locking ring 60 is a flat annular metal ring having a plurality of spaced preformed tabs 66 which are transverse with respect to ring 60. During installation, locking ring 60 is positioned between stabilizer 14 and locking nut 62 and upturned tabs 66 are intermeshed with slots 38'. Next, locking nut 62 is torqued against locking ring 60 and stabilizer 14. Finally, a punching tool is used to shear form additional tabs (not shown) on locking ring 60 which will be received by radial slots 64 on locking ring 62. As a result, ring 62 will be interlocked with stabilizer 14 through means of locking ring 60.

While preferred embodiment have been shown and described, various modifications and substitutions may be made thereto without departing from the spirit and scope of the invention. Accordingly, it is to be understood that the present invention has been described by way of illustrations and not limitation.

What is claimed is:

1. A bottomhole assembly including, a drilling motor, a bent sub upstream of the drilling motor and a drill bit downstream of the drilling motor, further comprising:

an offset stabilizer between said drilling motor and said drill bit, said offset stabilizer having a fixed degree of offset; and means for orienting and locking said offset stabilizer in a pre-selected position in alignment with said bent sub while maintaining said fixed degree of offset wherein said orienting and locking means comprises;

adapter ring means positioned between said stabilizer and said drilling motor, said adapter ring means having upper and lower opposed ends, said lower end including a plurality of radially arranged first slot means; and said stabilizer having opposed upper and lower ends, said upper end of said stabilizer including a plurality of radially arranged second slot means, said first and second slot means being complimentary and mutually interlocking.

2. The assembly of claim 1 including:

annular lock nut means between said lower end of said stabilizer and said drill bit, said annular lock nut means retaining said first and second slot means in interlocked engagement.

3. The assembly of claim 1 including:

indicia on said stabilizer for alignment with said bent sub.

4. The assembly of claim 3 wherein said stabilizer includes a plurality of differing sized ribs including a smallest rib and wherein:

said indicia is on one of said ribs for alignment with said bent sub.

5. The assembly of claim 4 wherein:

said indicia comprises at least one scribe line on the smallest of said ribs.

6. The assembly of claim 1 including:

a plurality of third slot means radially arranged on said lower end of said stabilizer.

7. A bottomhole assembly including, a drilling motor, a bent sub upstream of the drilling motor and a drill bit downstream of the drilling motor, further comprising;

an offset stabilizer between said drilling motor and said drill bit, said offset stabilizer having a fixed degree of offset; and means for orienting and locking said offset stabilizer in a pre-selected position in alignment with said bent sub while maintaining said fixed degree of offset wherein said orienting and locking means comprises;

a plurality of radially arranged first slot means on the drilling motor exterior; and said stabilizer having opposed upper and lower ends, said upper end of said stabilizer including a plurality of radially arranged second slot means, said first and second slot means being complimentary and mutually interlocking.

8. The assembly of claim 7 including:

spacer sleeve means having opposed first and second ends with third slot means on said first end and fourth slot means on said second end, said spacer sleeve means being positioned between said first slot means and said second slot means, said first and third slot means being complimentary and mutually interlocking, said second and fourth slot means being complimentary and mutually interlocking.

9. The assembly of claim 7 including:

annular lock nut means between said lower end of said stabilizer and said drill bit, said annular lock nut means retaining said first and second slot means in interlocked engagement.

10. The assembly of claim 2 including:

locking ring means between said annular lock nut means and said stabilizer, said locking means interlocking said annular lock nut means to said stabilizer.

11. The assembly of claim 9 including:

locking ring means between said annular lock nut means and said stabilizer, said locking ring means interlocking said annular lock nut means to said stabilizer.

12. A bottomhole assembly including, a drilling motor housed in a bent motor housing, and a drill bit downstream of the drilling motor, further comprising:

an offset stabilizer between said drilling motor and said drill bit, said offset stabilizer having a fixed degree of offset; and means for orienting and locking said offset stabilizer in a pre-selected position in alignment with said bent motor housing while maintaining said fixed degree of offset wherein said orienting and locking means comprises;

adapter ring means positioned between said stabilizer and said drilling motor, said adapter ring means having upper and lower opposed ends, said lower end including a plurality of radially arranged first slot means; and said stabilizer having opposed upper and lower ends, said upper end of said stabilizer including a plurality of radially arranged second slot means, said first and second slot means being complimentary and mutually interlocking.

13. The assembly of claim 13 including:

annular lock nut means between said lower end of said stabilizer and said drill bit, said annular lock nut means retaining said first and second slot means in interlocked engagement.

14. The assembly of claim 12 including:

indicia on said stabilizer for alignment with said bent motor housing.

15. The assembly of claim 14 wherein said stabilizer includes a plurality of differing sized ribs including a smallest rib and wherein:

said indicia is on one of said ribs for alignment with said bent motor housing.

16. The assembly of claim 15 wherein: said indicia comprises at least one scribe line on the smallest of said ribs.

17. The assembly of claim 13 including:

a plurality of third slot means radially arranged on said lower end of said stabilizer.

18. A bottomhole assembly including, a drilling motor housed in a bent motor housing, and a drill bit downstream of the drilling motor, further comprising:

an offset stabilizer between said drilling motor and said drill bit, said offset stabilizer having a fixed degree of offset; and means for orienting and locking said offset stabilizer in a pre-selected position in alignment with said bent motor housing while maintaining said fixed degree of offset wherein said orienting and locking means comprises;

a plurality of radially arranged first slot means on the drilling motor exterior; and said stabilizer having opposed upper and lower ends, said upper end of said stabilizer including a plurality of radially arranged second slot means, said first and second slot means being complimentary and mutually interlocking.

19. The assembly of claim 20 including:

spacer sleeve means having opposed first and second ends with third slot means on said first end and fourth slot means on said second end, said spacer sleeve means being positioned between said first slot means and said second slot means, said first and third slot means being complimentary and mutually interlocking, said second and fourth slot means being complimentary and mutually interlocking.

20. The assembly of claim 20 including:

annular lock nut means between said lower end of said stabilizer and said drill bit, said annular lock nut means retaining said first and second slot means in interlocked engagement.

21. The assembly of claim 15 including:

locking ring means between said annular lock nut means and said stabilizer, said locking ring means interlocking said annular lock nut means to said stabilizer.

22. The assembly of claim 22 including:

locking ring means between said annular lock nut means and said stabilizer, said locking ring means interlocking said annular lock nut means to said stabilizer.

23. In an offset stabilizer for use in a drill string, said offset stabilizer having a fixed degree of offset, the improvment comprising:

means for orienting and locking said offset stabilizer in a pre-selected position along the drill string while maintaining said fixed degree of offset wherein said orienting and locking means comprises;

adapter ring means positioned adjacent said stabilizer, said adapter ring means having upper and lower opposed ends, said lower end including a plurality of radially arranged first slot means; and said stabilizer having opposed upper and lower ends, said upper end of said stabilizer including a plurality of radially arranged second slot means, said first and second slot means being complimentary and mutually interlocking.

24. The assembly of claim 25 including:

annular lock nut means adjacent said lower end of said stabilizer, said annular lock nut means retaining said first and second slot means in interlocked engagement.

25. The assembly of claim 25 including:

indicia on said stabilizer for alignment with respect to the drill string.

26. The assembly of claim 25 wherein said stabilizer includes a plurality of differing sized ribs including a smallest rib and wherein:

said indicia is on one of said ribs for alignment with respect to the drill string.

27. The assembly of claim 26 wherein:

said indicia comprises at least one scribe line on the smallest of said ribs.

28. The assembly of claim 27 including:

locking ring means between said annular lock nut means and said stabilizer, said locking ring means interlocking said annular lock nut means to said stabilizer.

29. A bottomhole assembly including, a drilling motor, a bent sub upstream of the drilling motor and a drill bit downstream of the drilling motor, further comprising:

an offset stabilizer between said motor and said drill bit;

means for orienting and locking said offset stabilizer in a pre-selected position in alignment with said bent sub wherein said orienting and locking means comprises;

adapter ring means positioned between said stabilizer and said drilling motor, said adapter ring means having upper and lower opposed ends, said lower end including a plurality of radially arranged first slot means; and said stabilizer having opposed upper and lower ends, said upper end of said stabilizer including a plurality of radially arranged second slot means, said first and second slot means being complimentary and mutually interlocking; and indicia on said stabilizer for alignment with said bent sub wherein said stabilizer includes a plurality of differing sized ribs including a smallest rib and wherein said indicia is on one of said ribs for alignment with said bent sub.

30. The assembly of claim 29 wherein:

said indicia comprises at least one scribe line on the smallest of said ribs.

31. A bottomhole assembly including, a drilling motor, a bent sub upstream of the drilling motor and a drill bit downstream of the drilling motor, further comprising:

an offset stabilizer between said drilling motor and said drill bit;

means for orienting and locking said offset stabilizer in a pre-selected position in alignment with said bent sub wherein said orienting and locking means comprises;

adapter ring means positioned between said stabilizer and said drilling motor, said adapter ring means having upper and lower opposed ends, said lower end including a plurality of radially arranged first slot means; and said stabilizer having opposed upper and lower ends, said upper end of said stabilizer including a plurality of radially arranged second slot means, said first and second slot means being complimentary and mutually interlocking; and a plurality of third slot means radially arranged on said lower end of said stabilizer.

32. A bottomhole assembly including, a drilling motor, a bent sub upstream of the drilling motor and a drill bit downstream of the drilling motor, further comprising:

an offset stabilizer between said drilling motor and said drill bit;

means for orienting and locking said offset stabilizer in a pre-selected position in alignment with said bent sub wherein said orienting and locking means comprises;

a plurality of radially arranged first slot means on the drilling motor exterior; and said stabilizer having opposed upper and lower ends, said upper end of said stabilizer including a plurality of radially arranged second slot means, said first and second slot means being complimentary and mutually interlocking; and spacer sleeve means having opposed first and second ends with third slot means on said first end and fourth slot means on said second end, said spacer sleeve means being positioned between said first slot means and said second slot means, said first and third slot means being complimentary and mutually interlocking, said second and fourth slot means being complimentary and mutually interlocking.

33. A bottomhole assembly including, a drilling motor, a bent sub upstream of the drilling motor and a drill bit downstream of the drilling motor, further comprising:

an offset stabilizer between said drilling motor and said drill bit;

means for orienting and locking said offset stabilizer in a pre-selected position in alignment with said bent sub wherein said orienting and locking means comprises;

adapter ring means positioned between said stabilizer and said drilling motor, said adapter ring means having upper and lower opposed ends, said lower end including a plurality of radially arranged first slot means; and said stabilizer having opposed upper and lower ends, said upper end of said stabilizer including a plurality of radially arranged second slot means, said first and second slot means being complimentary and mutually interlocking;

annular lock nut means between said lower end of said stabilizer and said drill bit, said annular lock nut means retaining said first and second slot means in interlocked engagement; and locking ring means between said annular lock nut means and said stabilizer, said locking ring means interlocking said annular lock nut means to said stabilizer.

34. A bottomhole assembly including, a drilling motor, a bent sub upstream of the drilling motor and a drill bit downstream of the drilling motor, further comprising:

an offset stabilizer between said drilling motor and said drill bit;

means for orienting and locking said offset stabilizer in a pre-selected position in alignment with said bent sub wherein said orienting and locking means comprises;

a plurality of radially arranged first slot means on the drilling motor exterior; and said stabilizer having opposed upper and lower ends, said upper end of said stabilizer including a plurality of radially arranged second slot means, said first and second slot means being complimentary and mutually interlocking;

spacer sleeve means having opposed first and second ends with third slot means on said first end and fourth slot means on said second end, said spacer sleeve means being positioned between said first slot means and said second slot means, said first and third slot means being complimentary and mutually interlocking, said second and fourth slot means being complimentary and mutually interlocking; and locking ring means between said annular lock nut means and said stabilizer, said locking ring means interlocking said annular lock nut means to said stabilizer.

35. A bottomhole assembly including, a drilling motor housed in a bent motor housing, and a drill bit downstream of the drilling motor, further comprising:

an offset stabilizer between said drilling motor and said drill bit;

means for orienting and locking said offset stabilizer in a pre-selected position in alignment with said bent motor housing wherein said orienting and locking means comprises;

adapter ring means positioned between said stabilizer and said drilling motor, said adapter ring means having upper and lower opposed ends, said lower end including a plurlaity of radially arranged first slot means; and said stabilizer having opposed upper and lower ends, said upper end of said stabilizer including a plurality of radially arranged second slot means, said first and second slot means being complimentary and mutually interlocking;

indicia on said stabilizer for alignment with said bent motor housing;

wherein said stabilizer includes a plurality of differing sized ribs including a smallest rib and wherein said indicia is on one of said ribs for alignment with said bent motor housing.

36. The assembly of claim 35 wherein:

said indicia comprises at least one scribe line on the smallest of said ribs.

37. A bottomhole assembly including, a drilling motor housed in a bent motor housing, and a drill bit downstream of the drilling motor, further comprising:

an offset stabilizer between said drilling motor and said drill bit;

means for orienting and locking said offset stabilizer in a pre-selected position in alignment with said bent motor housing wherein said orienting and locking means comprises;

adapter ring means positioned between said stabilizer and said drilling motor, said adapter ring means having upper and lower opposed ends, said loewr end including a plurality of radially arranged first slot means; and said stabilizer having opposed upper and lower ends, said upper end of said stabilizer including a plurality of radially arranged second slot means, said first and second slot means being complimentary and mutually interlocking;

annular lock nut means between said lower end of said stabilizer and said drill bit, said annular lock nut means retaining said first and second slot means in interlocked engagement; and a plurality of third slot means radially arranged on said lower end of said stabilizer.

38. A bottomhole assembly including, a drilling motor housed in a bent motor housing, and a drill bit downstream of the drilling motor, further comprising:

an offset stabilizer between said drilling motor and said drill bit;

means for orienting and locking said offset stabilizer in a pre-selected position in alignment with said bent motor housing wherein said orienting and locking means comprises;

a plurality of radially arranged first slot means on the drilling motor exterior;

said stabilizer having opposed upper and lower ends, said upper end of said stabilizer including a plurality of radially arranged second slot means, said first and second slot means being complimentary and mutually interlocking; and spacer sleeve means having opposed first and second ends with third slot means on said first end and fourth slot means on said second end, said spacer sleeve means being positioned between said first slot means and said second slot means, said first and third slot means being complimentary and mutually interlocking, said second and fourth slot means being complimentary and mutually interlocking.

39. A bottom hole assembly including, a drilling motor housed in a bent motor housing, and a drill bit downstream of the drilling motor, further comprising:

an offset stabilizer between said drilling motor and said drill bit;

means for orienting and locking said offset stabilizer in a pre-selected position in alignment with said bent motor housing wherein said orienting and locking means comprises;

adapter ring means positioned between said stabilizer and said drilling motor, said adapter ring means having upper and lower opposed ends, said lower end including a plurality of radially arranged first slot means; and said stabilizer having opposed upper and lower ends, said upper end of said stabilizer including a plurality of radially arranged second slot means, said first and second slot means being complimentary and mutually interlocking;

annular lock nut means between said lower end of said stabilizer and said drill bit, said annular lock nut means retaining said first and second slot means in interlocked engagement; and locking ring means between said annular lock nut means and said stabilizer, said locking ring means interlocking said annular lock nut means to said stabilizer.

40. A bottomhole assembly including, a drilling motor housed in a bent motor housing, and a drill bit downstream of the drilling motor, further comprising:

an offset stabilizer between said drilling motor and said drill bit;

means for orienting and locking said offset stabilizer in a pre-selected position in alignment with said bent motor housing wherein said orienting and locking means comprises;

a plurality of radially arranged first slot means on the drilling motor exterior; and said stabilizver having opposed upper and lower ends, said upper end of said stabilizer including a plurality of radially arranged second slot means, said first and second slot means being complimentary and mutually interlocking;

annular lock nut means between said lower end of said stabilizer and said drill bit, said annular lock nut means retaining said first and second slot means in interlocked engagement; and locking ring means between said annular lock nut means and said stabilizer, said locking ring means interlocking said annular lock nut means to said stabilizer.

41. In an offset stabilizer for use in a drill string, the improvement comprising:

means for orienting and locking said offset stabilizer in a pre-selected position along the drill string wherein said orienting and locking means comprises;

adapter ring means positioned adjacent said stabilizer, said adapter ring means having upper and lower opposed ends, said lower end including a plurality of radially arranged first slot means; and said stabilizer having opposed upper and lower ends, said upper end of said stabilizer including a plurality of radially arranged second slot means, said first and second slot means being complimentary and mutually interlocking; and indicia on said stabilizer for alignment with respect to the drill string wherein said stabilizer includes a plurality of differing sized ribs including a smallest rib and wherein said indicia is on one of said ribs for alignment with respect to the drill string.

42. The assembly of claim 41 wherein:

said indicia comprises at least one scribe line on the smallest of said ribs.

43. In an offset stabilizer for use in a drill string, the improvement comprising:

means for orienting and locking said offset stabilizer in a pre-selected position along the drill string wherein said orienting and locking means comprises;

adapter ring means positioned adjacent said stabilizer, said adapter ring means having upper and lower opposed ends, said lower end including a plurality of radially arranged first slot means;

said stabilizer having opposed upper and lower ends, said upper end of said stabilizer including a plurality of radially arranged second slot means, said first and second slot means being complimentary and mutually interlocking;

annular lock nut means adjacent said lower end of said stabilizer, said annular lock nut means retaining said first and second slot means in interlocked engagement; and locking ring means between said annular lock nut means and said stabilizer, said locking ring means interlocking said annular lock nut means to said stabilizer.

* * * * *